United States Patent [19]

Lowery et al.

[11] Patent Number: 4,538,701

[45] Date of Patent: Sep. 3, 1985

[54] MUFFLER

[75] Inventors: David C. Lowery, Manchester, Mich.; Robert W. Alyea, Grafton, Wis.

[73] Assignee: Tecumseh Products Company, Tecumseh, Mich.

[21] Appl. No.: 399,720

[22] Filed: Jul. 19, 1982

[51] Int. Cl.[3] ..... F01N 1/08

[52] U.S. Cl. ..... 181/274; 181/282

[58] Field of Search ..... 181/202, 212, 243, 265, 181/269, 274, 282, 296

[56] References Cited

U.S. PATENT DOCUMENTS

| | | | |
|---|---|---|---|
| 2,101,389 | 12/1937 | Fischer | 181/269 X |
| 2,928,491 | 2/1955 | Crouch | 181/269 |
| 2,942,684 | 6/1960 | Bennett | 181/274 |
| 3,177,973 | 4/1965 | Benes | 181/274 |
| 3,404,749 | 10/1968 | Miller et al. | 181/264 X |
| 3,519,098 | 7/1970 | Plaga, Jr. | 181/269 |
| 3,703,938 | 11/1972 | Nelson | 181/274 |
| 3,921,290 | 11/1975 | Bailey | 181/274 X |
| 4,184,566 | 1/1980 | Baker et al. | 181/269 X |
| 4,384,635 | 5/1983 | Lowery | 181/202 X |

FOREIGN PATENT DOCUMENTS

| | | |
|---|---|---|
| 57854/69 | 1/1971 | Australia . |
| 554601 | 7/1932 | Fed. Rep. of Germany . |
| 992706 | 10/1951 | France . |
| 1012028 | 12/1965 | United Kingdom . |

*Primary Examiner*—Russell E. Adams
*Assistant Examiner*—Brian W. Brown
*Attorney, Agent, or Firm*—Albert L. Jeffers; John F. Hoffman

[57] ABSTRACT

Improvements in the attenuation of sounds emitted by an internal combustion engine exhaust system are achieved by shaping a muffler housing to substantially eliminate flat sound radiating surfaces, providing a circuitous exhaust gas flow path within the muffler housing and around an imperforate barrier and providing an exhaust gas outlet from the muffler housing which extends generally perpendicular to the direction of sound propagation within the housing near that outlet. The housing may be generally ellipsoidal in shape having a non-zero curvature which varys in a continuous manner at substantially all points on the surface and, subject to that requirement, designed to have a generally maximal volume subject to the dimensional constraints of its environment.

5 Claims, 6 Drawing Figures

MUFFLER

BACKGROUND OF THE INVENTION

The present invention relates generally to noise attenuators and more particularly to improvements in exhaust gas mufflers of the type having an enclosure with an inlet for receiving exhaust gas from an engine and an outlet for venting the exhaust gas to the atmosphere.

Internal combustion engines having exhaust gases ported directly to the atmosphere emit loud and noxious noises with this problem being accentuated somewhat in two stroke cycle engines and hence the need for some type exhaust noise attentuation has long been recognized. Attempts to fill this need have generally taken the form of an enclosure with inlet and outlet openings containing one or more perforated baffles.

Typically the muffler shell or housing is formed with a generally tubular shape of circular or oval cross section and opposed generally flat ends through one of which an inlet pipe passes and through the other of which an outlet pipe passes. Some muffler housing designs have had their shape dictated by rather stringent application limitations and have been formed as stamped sheet metal portions joined together and generally having at least a pair of flat sides. This latter type design might for example be required in a chain saw muffler. At least one spherical muffler housing has also been proposed.

The flat sided muffler housings as well as the tubular housings both have relatively large flat surfaces which are unfortunately good sound radiators tending to defeat the noise attenuating purpose of these mufflers. The proposed spherical muffler housing obviates this problem but unfortunately accentuates a different problem. The engine output consumed in pumping the exhaust gas through the muffler system cannot be harnessed as useful output and thus the harder the engine must work to exhaust the gases the less efficient that engine will be. So-called back pressure, that is, gas pressure opposing the exhausting operation increases as a muffler volume decreases and, since the space available as determined by the dimensional constraints of the engine environment is rarely spherical, the spherical design muffler typically does not utilize nearly all of the space available and therefore presents a characteristically small volume and therefor relatively higher back pressure reducing engine efficiency. The size and number of openings in perforated baffles within a muffler represents a similar trade off wherein enhanced sound attenuation results in reduced engine efficiency.

SUMMARY OF THE INVENTION

Among the several objects of the present invention may be noted a scheme for lowering muffler sound levels while improving the tonal quality thereof yet maintaining generous gas flow areas to increase engine shaft power thereby allowing the use of smaller and lighter engines for the same application; the provision of a muffler housing having a non-zero curvature which varies in a continuous manner at substantially all points on its surface; the provision of a muffler having an imperforate interior barrier between its inlet and outlet providing a circuitous exhaust gas path inducing a substantial change in the direction of gas flow therethrough; the provision of sound barriers within a muffler casting acoustic shadows and reducing sound levels with the reduction of higher frequency sounds being more pronounced; the provision of a muffler arrangement which takes advantage of the available space for its installation reducing noise without unduly reducing engine efficiency; and an overall improvement in the philosophy of muffler design. These as well as other objects and advantageous features of the present invention will become in part apparent and in part pointed out hereinafter.

In general, mufflers are designed according to the present invention to have a shell or housing shaped to provide an enhanced internal volume for smoothing exhaust gas pulsations while having a surface which is a poor sound radiator and to have internal baffling which tends to cast acoustic shadows reducing harsh and piercing sounds eminating from the muffler.

Also in general and in one form of the invention, improvements in exhaust gas mufflers of the type having an enclosure with an inlet for receiving exhaust gas from an engine and an outlet for venting the exhaust gas to the atmosphere include the provision of imperforate barriers within the enclosure intermediate the inlet and outlet providing circuitous exhaust gas paths only between the inlet and outlet and preferrably providing a substantial change in direction of exhaust gas flow, shaping the enclosure to be generally ellipsoidal with non-zero curvature at substantially all points on the surface with any curvature changes occurring in a continuous manner, and forming the outlet as a tube within the enclosure with one end opening to the enclosure exterior and the other opening within the enclosure generally perpendicular to the direction of sound propagation therein and further including an imperforate barrier intermediate the inlet and outlet around which exhaust gas flows in a devious path to the tube.

BRIEF DESCRIPTION OF THE DRAWING

Corresponding parts are identified by corresponding reference characters throughout the severall views of the drawing.

The exemplifications set out herein illustrate a preferred embodiment of the invention in one form thereof and such exemplifications are not be to construed as limiting the scope of the disclosure or the scope of the invention in any manner.

DESCRIPTION OF THE PREFERRED EMBODIMENT

Figure 1:
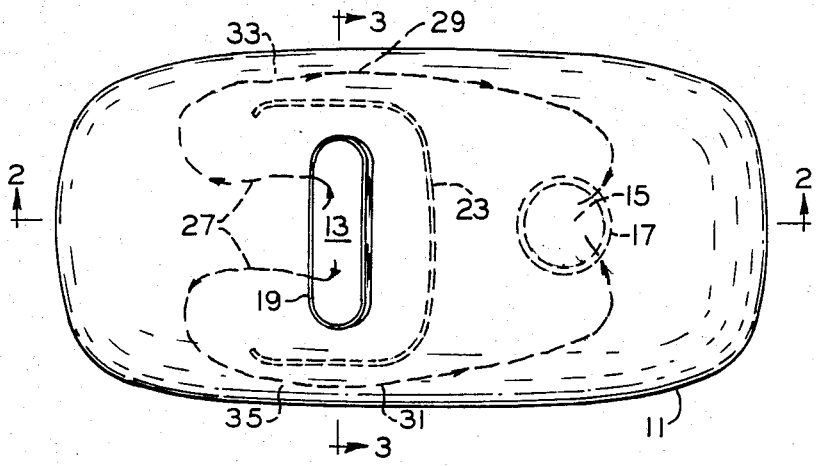
FIG. 1 is a plan view of an exhaust gas muffler illustrating the invention in one form.
Figure 2:
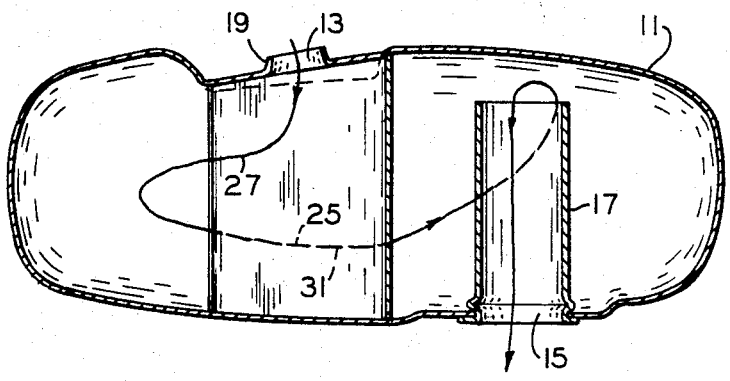
FIG. 2 is a view in section along line 2—2 of FIG. 1.
Figure 3:
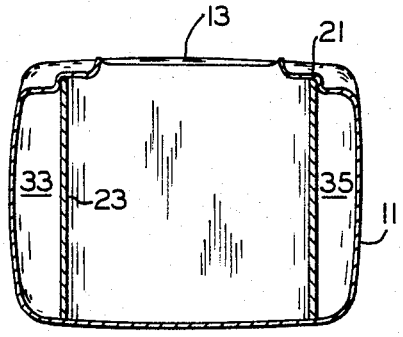
FIG. 3 is a view in cross-section along line 3—3 of FIG. 1.

Referring first to the muffler of FIGS. 1, 2 and 3, the shell or housing 11 of this muffler has been designed for a generally rectangular available space in an internal combustion engine installation. The housing 11 functions as an enclosure with an exhaust gas inlet 13 for receiving exhaust gas from an engine and an outlet 15 for venting the exhaust gas to the atmosphere. Of course, the outlet 15 may optionally be connected to a further conduit to vent the exhaust gas to atmosphere at any preferred location. It will be noted that the housing 11 has a non-zero curvature (no flat surfaces) which curvature is continuous varying over the surface of the housing except for design considerations where, for example, the housing 11 is attached to the outlet tube 17 or the flange 19 is provided for the inlet 13 or as in FIG. 3 at 21 for the purposes of mounting an interior imperforate baffle 23. In some designs according to the present invention, the curvature may be constant, that is, not continuously varying at certain points or in certain planes, however, where changes in curvature do occur, those changes occur in a discontinuity-free manner. In these cases, the curvature is said to vary in a continuous manner. Thus, in the design depicted in FIGS. 1 through 3 substantially all flat sound radiating surfaces have been eliminated. A weld or flange may be provided so that housing 11 may be formed as two housing halves, the tube 17 and baffle 23 assembled therein and then the housing halves joined to form the completed muffler, however, such flange or joint is not illustrated in the drawing.

The path along which the exhaust gas flows within the housing illustrated generally by the dotted line 25 beginning at inlet 13 passing initially downwardly then bending through a first approximately right angle to proceed away from the outlet 15 as at 27. The flow then splits and reverses direction to pass by the sides of baffle 23 as at 29 and 31. At this time the direction of the flow path is approximately perpendicular to the axis of imperforate outlet tube 17. Significantly, the direction of sound propagation near the interior end of outlet tube 17 is generally perpendicular to the axis of that tube giving the acoustic shadow effect to be discussed subsequently. The exhaust gas proceeds making a further approximately right angle turn and then journeys downwardly through tube 17 to the atmosphere. Thus it will be seen that an approximately 360° change in direction of exhaust gas flow has been experienced within the housing 11.

Housing 11 of FIGS. 1, 2 and 3 is generally described as being elllipsoidal since this term is the closest of the commonly known solid shape names but, of course, the housing is not a true ellipsoid but may be thought of as a generalization of the concept of an ellipsoid. Specifically, the term ellipsoid does not include a sphere.

Both tube 17 and baffle 23 are imperforate in the sense that no holes or perforations occur in their side walls. The entirety of the exhaust gas must, as seen in FIG. 3, pass along the outside of the imperforate baffle 23 at 33 and 35. Similarly, the exhaust gas must all enter the upper opening of tube 17 to be exhausted to atmosphere. This bending of the exhaust gas flow path around corners such as represented by the upper rim of tube 17 or the edges of the the imperforate baffle 23 contributes substantially to the noise attenuating aspects of the present invention and is particularly effective on the harsh and piercing higher frequencies emitted by the engine. Sound behaves somewhat like light and tends to propagate in straight lines. Also, somwhat like a light wave, sound waves experience a difraction effect at corners with the lower frequency sound waves passing around the corners more readily than the higher frequency sound waves. Thus, the baffle and tube 17 which is orthogonally positioned relative to the general direction of sound propagation within the muffler cavity both tend to pass the lower frequency sounds with less attenuation than the higher frequency sounds providing a better tonal quality to the audible output of the muffler. Such corners are said to cast acoustic shadows.

While initial exhaust gas expansion is occuring essentially in the left half of the muffler as viewed in FIGS. 1, 2 and 3, a significant percentage increasse in this initial expansion chamber volume may in some cases be desired to better smooth the pulsating engine exhaust. Such an increase is illustrated by the initial expansion chamber 37 of the muffler of FIGS. 4, 5 and 6. This as well as several other structural differences between the two depicted mufflers will serve to illustrate further the principles of the present invention as well as the bounds on the principles thereof. The muffler housing or shell 39 has been configured to make nearly maximum utilization of the available space in a particular engine installation to provide a nearly maximum muffler volume at the expense of introducing some flat surfaces so that the muffler housing surface is unfortunately a better sound radiator.

Figure 4:
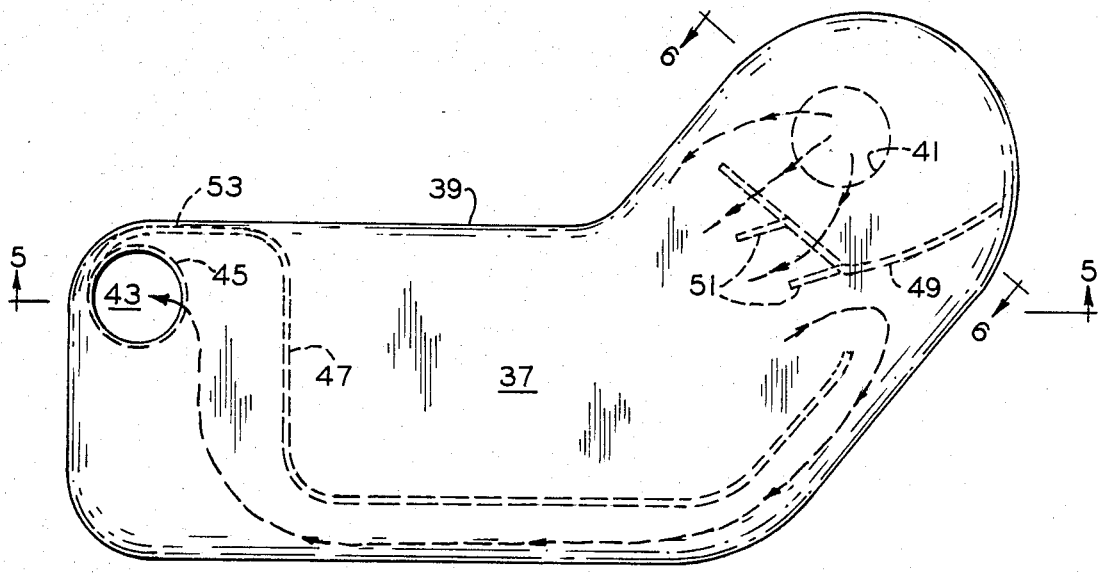
FIG. 4 is a plan view of an exhaust gas muffler illustrating variations on the principles of the present invention.
Figure 5:
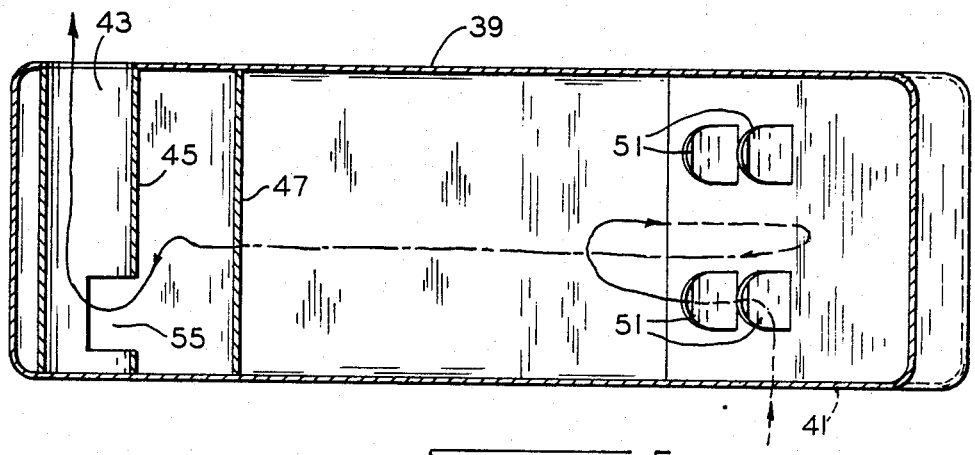
FIG. 5 is a view in cross-section along line 5—5 of FIG. 4.
Figure 6:
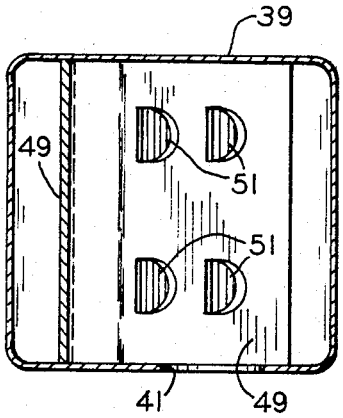
FIG. 6 is a view in cross-section along line 6—6 of FIG. 4.

As in the earlier described muffler, the muffler of FIGS. 4, 5 and 6 includes an exhaust gas inlet 41, an exhaust gas outlet 43, an internal outlet tube 45 extending axially generally normal to the direction of exhaust gas flow through the muffler and an imperforate barrier 47 around which the exhaust gas path must bend. A second nearly imperforate barrier 49 is positioned near inlet 41 but is provided with a series of louvers such as 51 which direct the exhaust gas from inlet 41 into the relatively large expansion chamber 37. As before, the exhaust gas path is illustrated by dotted lines with that exhaust gas entering inlet 41, bending through approximately a right angle and passing around baffle 49 as well as through the several apertures associated with the louvers such as 51, into expansion chamber 37 and thence around the corner of baffle 47 and along the rather long narrow channel adjacent that baffle to ultimately experience a second nearly right angle bend passing outwardly through tube 45 and outlet 43. It will be noted that baffle 47 is in contact with a side wall of the housing 39 along a rather extensive region 53 which functions as a friction damping interface between the housing 39 and baffle 47 tending to reduce housing vibration. This second version of the present invention, like the first, casts acoustic shadows from the baffle 49, imperforate barrier 47 and the opening 55 into exhaust tube 45 each time diminishing noise transmission particularly the higher frequency harsh sounds of the engine exhaust.

Comparison of the two illustrated embodiments shows that maximizing volume and maximizing curvature are frequently competing considerations to be traded off one against the other, however, curvature discontinuities should still be avoided. In each embodiment it will be noted that the general direction of exhaust gas flow within the enclosure is the direction of elongation of the housing and that gas flow direction at the inlet and outlet is generally parallel but laterally displaced one from the other.

From the foregoing it is now apparent that attenuation of the sound emitted by an internal combustion engine exhaust gas muffler has been achieved meeting the objects and advantageous features set out hereinbefore as well as others, and that modifications as to the precise configurations, shapes and details may be made by those having ordinary skill in the art without departing from the spirit of the invention and the scope thereof as set out by the claims which follow.

What is claimed is:

1. An exhaust gas muffler comprising: an elongate enclosure having a longitudinal axis, said enclosure having an inlet for receiving exhaust gas from an engine, and an outlet for venting the exhaust gas to the atmosphere, exhaust gas flow and sound propagation within said enclosure being generally axially between the inlet and outlet, said enclosure being generally ellipsoidal in shape and having non-zero continuously varying curvature at substantially all points on its inner surface; said outlet comprising a tube having a generally straight imperforate portion thereof disposed within the enclosure with one end thereof opening to the exterior of the enclosure and the other end opening within the enclosure, said tube portion being generally perpendicular to the axial flow of the gas and sound propagation; and an imperforate baffle contained within the enclosure intermediate the inlet and outlet, said baffle being transverse to the longitudinal axis of the enclosure and having edges spaced inwardly from the enclosure thereby forming a plurality of gas flow openings.

2. The muffler of claim 1 wherein said baffle is positioned near the inlet and partially surrounds the exhaust gas entering the enclosure through the inlet, said baffle substantially intercepts exhaust gas as the exhaust gas initially enters the enclosure so that a portion of the exhaust gas passes through each of said exhaust gas flow openings.

3. The muffler of claim 1 wherein the total change in direction of exhaust gas flow from the inlet to the gas outlet is about 360°.

4. The muffler of claim 1 wherein the direction of exhaust gas flow at the inlet is generally parallel to and displaced laterally from the direction of exhaust gas flow through the outlet.

5. The muffler of claim 1 wherein said imperforate baffle is U-shaped and has a rear wall and sidewalls, said sidewalls being spaced inwardly from a pair of opposite walls of the enclosure so as to form said plurality of exhaust gas flow openings, said inlet opening into an area in said enclosure partially surrounded by the baffle sides and rear walls.

* * * * *